US010890132B2

(12) United States Patent
Sasaki et al.

(10) Patent No.: US 10,890,132 B2
(45) Date of Patent: Jan. 12, 2021

(54) INTERNAL COMBUSTION ENGINE CONTROL DEVICE

(71) Applicant: HONDA MOTOR CO., LTD., Tokyo (JP)

(72) Inventors: Ryo Sasaki, Tochigi (JP); Takahiro Kashima, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/497,162

(22) PCT Filed: Mar. 13, 2018

(86) PCT No.: PCT/JP2018/009735
§ 371 (c)(1),
(2) Date: Sep. 24, 2019

(87) PCT Pub. No.: WO2018/180467
PCT Pub. Date: Oct. 4, 2018

(65) Prior Publication Data

US 2020/0102903 A1 Apr. 2, 2020

(30) Foreign Application Priority Data

Mar. 27, 2017 (JP) ..... 2017-060937

(51) Int. Cl.
*F02D 41/20* (2006.01)
*F02D 41/30* (2006.01)

(52) U.S. Cl.
CPC ..... *F02D 41/20* (2013.01); *F02D 41/30* (2013.01)

(58) Field of Classification Search
CPC .... F02D 41/20; F02D 41/30; F02D 2200/021; F02D 2200/022; F02D 2041/2065
USPC ..... 701/101–105, 107, 113–115
See application file for complete search history.

(56) References Cited

U.S. PATENT DOCUMENTS 10,066,570 B2 * 9/2018 Morris ..... F02D 35/027
2001/0050074 A1 * 12/2001 Kawakami ..... F02D 41/065 123/491
2008/0072879 A1 3/2008 Nagase et al.
2011/0071771 A1 * 3/2011 Viale ..... G01K 7/16 702/45

FOREIGN PATENT DOCUMENTS

DE 10 2008 042 985 A1 4/2010
JP 2000-073901 A 3/2000
JP 2008-086119 A 4/2008
JP 2012-246821 A 12/2012
(Continued)

OTHER PUBLICATIONS

Extended European search report issued in the counterpart EP Patent Application No. 18776772.8 dated Feb. 3, 2020.

*Primary Examiner* — John Kwon
*Assistant Examiner* — Johnny H Hoang
(74) *Attorney, Agent, or Firm* — Carrier Blackman & Associates, P.C.; Joseph P. Carrier; Jeffrey T. Gedeon

(57) ABSTRACT

An internal combustion engine control device (1) includes an injector-temperature calculation unit (21*a*), an engine-temperature calculation unit (21*b*), an operating-state control unit (21*c*), and an integration-time calculation unit (21*d*). The engine-temperature calculation unit (21*b*) calculates an engine temperature by using an injector temperature and a fuel-injection integration time.

3 Claims, 5 Drawing Sheets

(56) References Cited

FOREIGN PATENT DOCUMENTS

| | | | |
|---|---|---|---|
| JP | 2013-130155 | A | 7/2013 |
| JP | 2016-098665 | A | 5/2016 |
| JP | 2016-176346 | A | 10/2016 |
| WO | 2014/171491 | A1 | 10/2014 |

* cited by examiner

INTERNAL COMBUSTION ENGINE CONTROL DEVICE

TECHNICAL FIELD

The present invention relates to an internal combustion engine control device, and more particularly relates to an internal combustion engine control device that is applied to a vehicle such as a two-wheeled automobile.

BACKGROUND ART

In recent years, in a vehicle such as a small two-wheeled automobile, since it becomes difficult in a carburetor system to meet the exhaust gas regulation that becomes tougher in the future, adoption of a fuel injection system has been promoted in order to reduce exhaust gas. However, the selling price of the vehicle such as the small two-wheeled automobile is more inexpensive than the selling price of a large two-wheeled automobile and a four-wheeled automobile. Therefore, when considering the selling price, it is difficult to directly adopt the fuel injection system, whose cost is higher than that of the carburetor system, for the vehicle such as the small two-wheeled automobile. Accordingly, in the vehicle such as the small two-wheeled automobile, cost reduction is demanded for components related to the fuel injection system, particularly, for sensors.

For example, a temperature sensor in the fuel injection system is generally used to detect a warmed-up state of an internal combustion engine. Specifically, the fuel injection system calculates a temperature of the internal combustion engine based on an output of the temperature sensor and detects the warmed-up state of the internal combustion engine based on the temperature of the internal combustion engine calculated in this way, to control an ignition timing and fuel injection. Therefore, when a fuel injection system is to be adopted, the temperature sensor needs to be attached to the internal combustion engine. Furthermore, when the temperature sensor is installed in the internal combustion engine, wires or couplers for interconnection need to be installed and a portion of the internal combustion engine where the temperature sensor is to be installed needs to be processed. As a result, the ratio of the cost of the fuel injection system in the selling price becomes higher than that of the carburetor system. Accordingly, particularly in an internal combustion engine control device that controls the fuel injection system in a vehicle such as a small two-wheeled automobile, omission of the temperature sensor from the fuel injection system is demanded to reduce the cost.

Under such circumstances, Patent Literature 1 relates to an electronic control device 20 of an engine 10, and discloses a configuration in which a temperature of the engine 10 is calculated based on a temperature of an injector 15 to control the engine 10 based on the calculated temperature of the engine 10, focusing on a correlation between the temperature of the injector 15 and the temperature of the engine 10.

PRIOR ART DOCUMENT

Patent Document

Patent Document 1: Japanese Patent Application Laid-open No. 2016-98665

SUMMARY OF THE INVENTION

Problem to be Solved by the Invention

However, according to the studies made by the present inventors, an injector and an internal combustion engine have heat capacities different from each other, cooling rates of traveling wind on the injector and the internal combustion engine are different from each other. Therefore, according to the configuration disclosed in Patent Literature 1, it can be considered that when the driving wind becomes strong with an increase of a vehicle speed, a divergence occurs between the temperature of the internal combustion engine (internal combustion engine temperature) calculated based on the temperature of the injector (injector temperature) and the actual temperature of the internal combustion engine.

The present invention has been achieved through the above studies, and an object of the present invention is to provide an internal combustion engine control device that can calculate the internal combustion engine temperature appropriately, taking into consideration a fact that the internal combustion engine temperature is affected by the driving wind, at the time of calculating the internal combustion engine temperature based on the injector temperature.

Means for Solving the Problem

In order to achieve the above object, a first aspect of the present invention provides an internal combustion engine control device applied to an internal combustion engine, the internal combustion engine control device comprising: an injector-temperature calculation unit that calculates an injector temperature based on a coil resistance value of an injector; an internal-combustion-engine temperature calculation unit that calculates a temperature of the internal combustion engine based on the injector temperature; and an operating-state control unit that controls an operating state of the internal combustion engine based on the temperature of the internal combustion engine, wherein the internal combustion engine control device further comprises an integration-time calculation unit that calculates a driving time of the injector and calculates a fuel-injection integration time obtained by integrating the driving time in a predetermined period, and the internal-combustion-engine temperature calculation unit calculates the temperature of the internal combustion engine by using the injector temperature and the fuel-injection integration time.

According to a second aspect of the present invention, in addition to the first aspect, the internal-combustion-engine temperature calculation unit calculates the temperature of the internal combustion engine by using the injector temperature and a value obtained by dividing the fuel-injection integration time by the predetermined period.

According to a third aspect of the present invention, in addition to the first or second aspect, the internal-combustion-engine temperature calculation unit calculates a corrected injector temperature obtained by correcting the injector temperature by a correction value having a correlation with the fuel-injection integration time in the predetermined period, and calculates the temperature of the internal combustion engine based on the corrected injector temperature.

According to a fourth aspect of the present invention, in addition to the third aspect, the internal-combustion-engine temperature calculation unit calculates a correction target value having a correlation with the fuel-injection integration time in the predetermined period, and gradually shifts the correction value toward the correction target value.

According to a fifth aspect of the present invention, in addition to the first aspect, the internal-combustion-engine temperature calculation unit calculates a corrected injector temperature obtained by correcting the injector temperature by a correction value having a correlation with the fuel-injection integration time in the predetermined period, calculates a base temperature of the internal combustion engine based on the corrected injector temperature, and calculates the temperature of the internal combustion engine by correcting the base temperature of the internal combustion engine by a correction value having a correlation with the fuel-injection integration time in the predetermined period.

Effect of the Invention

A degree of influence of the driving wind on the injector temperature can be estimated from the vehicle speed, and the vehicle speed can be estimated by calculating a fuel-injection integration time obtained by integrating driving time in the predetermined period. Therefore, according to the internal combustion engine control device of the first aspect of the present invention, the internal-combustion-engine temperature calculation unit calculates the temperature of the internal combustion engine by using the injector temperature and the fuel-injection integration time. Accordingly, when the temperature of the internal combustion engine is calculated based on the injector temperature, the temperature of the internal combustion engine can be calculated appropriately, taking the influence of the driving wind into consideration, by estimating the vehicle speed based on a correlation between the fuel-injection integration time and the vehicle speed in the predetermined period.

According to the internal combustion engine control device of the second aspect of the present invention, the internal-combustion-engine temperature calculation unit calculates the temperature of the internal combustion engine by using the injector temperature and the value obtained by dividing the fuel-injection integration time by the predetermined period. Accordingly, the temperature of the internal combustion engine can be calculated appropriately, taking the influence of the driving wind into consideration.

According to the internal combustion engine control device of the third aspect of the present invention, the internal-combustion-engine temperature calculation unit calculates the corrected injector temperature obtained by correcting the injector temperature by the correction value having the correlation with the fuel-injection integration time in the predetermined period, and calculates the temperature of the internal combustion engine based on the corrected injector temperature. Accordingly, the temperature of the internal combustion engine can be calculated appropriately with a simple configuration, taking the influence of the driving wind into consideration.

According to the internal combustion engine control device of the fourth aspect of the present invention, the internal-combustion-engine temperature calculation unit calculates the correction target value having the correlation with the fuel-injection integration time in the predetermined period, and gradually shifts the correction value toward the correction target value. Accordingly, the temperature of the internal combustion engine can be calculated appropriately in accordance with a change of the actual injector temperature, taking into consideration a fact that a cooling effect by the driving wind does not appear on the injector temperature immediately.

According to the internal combustion engine control device of the fifth aspect of the present invention, the internal-combustion-engine temperature calculation unit calculates the corrected injector temperature obtained by correcting the injector temperature by the correction value having the correlation with the fuel-injection integration time in the predetermined period, calculates the base temperature of the internal combustion engine based on the corrected injector temperature, and calculates the temperature of the internal combustion engine by correcting the base temperature of the internal combustion engine by the correction value having the correlation with the fuel-injection integration time in the predetermined period. Accordingly, the temperature of the internal combustion engine can be calculated appropriately with a simple configuration, taking the influence of the driving wind into consideration.

EMBODIMENT FOR CARRYING OUT THE INVENTION

An internal combustion engine control device according to an embodiment of the present invention will be explained below in detail with reference to the accompanying drawings.

[Configuration of Internal Combustion Engine Control Device]

Figure 1A:
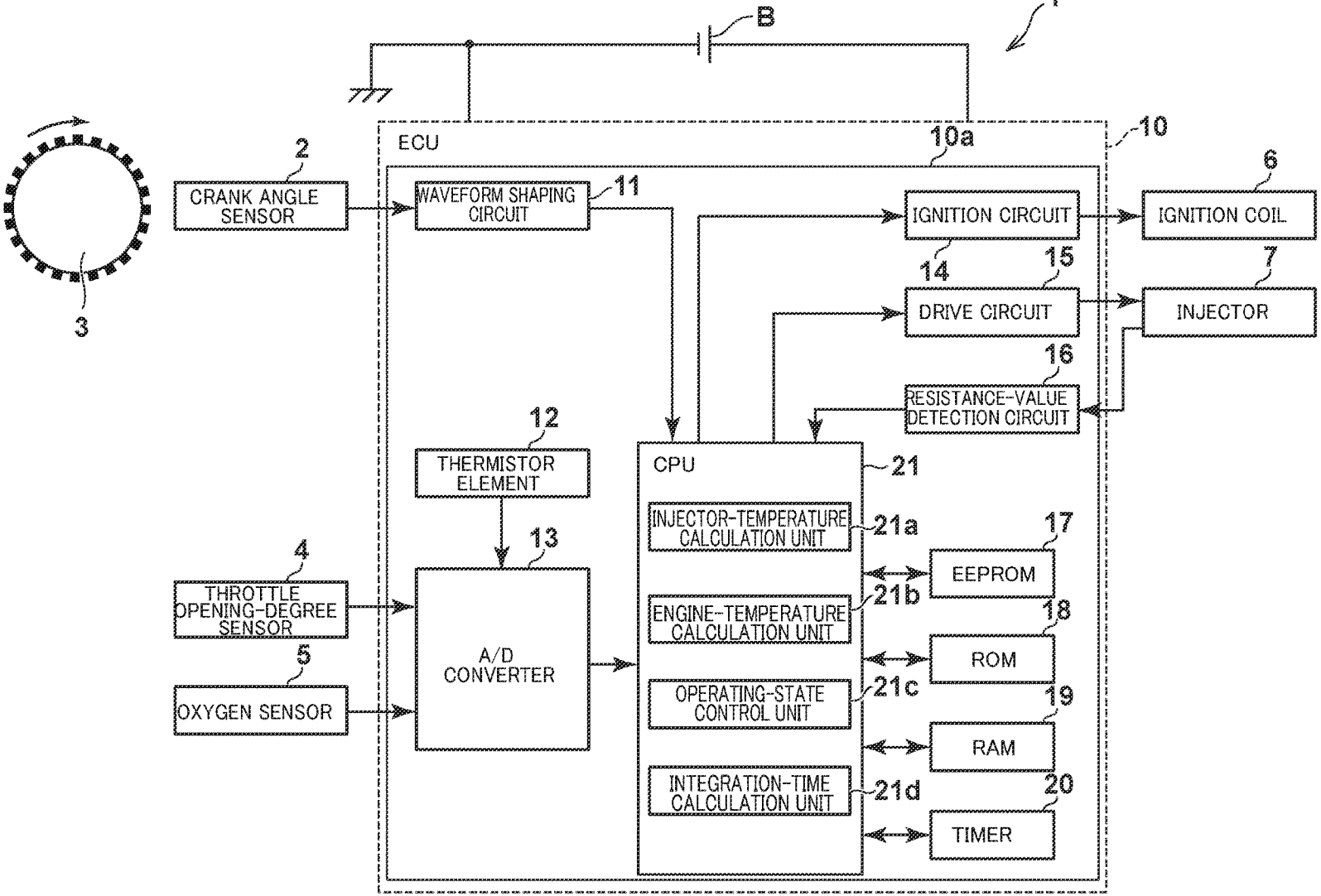
FIG. 1A is a schematic diagram showing a configuration of an internal combustion engine control device according to an embodiment of the present invention.
Figure 1B:
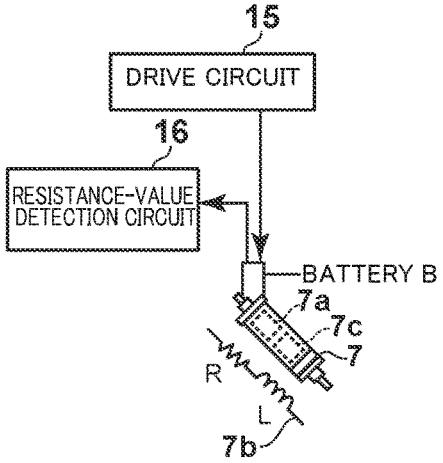
FIG. 1B is a schematic diagram showing a configuration of an injector in FIG. 1A.

A configuration of an internal combustion engine control device according to the present embodiment is explained first with reference to FIGS. 1A and 1B. While the internal combustion engine control device according to the present embodiment is typically preferably mounted on an internal combustion engine mount body, for example, a vehicle such as a two-wheeled automobile, the present embodiment is explained below assuming the internal combustion engine control device is mounted on a vehicle such as a two-wheeled automobile for the sake of convenience.

FIG. 1A is a schematic diagram showing a configuration of the internal combustion engine control device according to the present embodiment, and FIG. 1B is a schematic diagram showing a configuration of an injector in FIG. 1A.

As shown in FIGS. 1A and 1B, an internal combustion engine control device 1 according to the present embodiment controls the operating state of an engine being an internal combustion engine such as a gasoline engine mounted on a vehicle (all not shown) on the basis of the temperature of a functional equipment of the engine, and includes an electronic control unit (ECU) 10.

The ECU 10 operates with power from a battery B mounted on the vehicle and includes a waveform shaping circuit 11, a thermistor element 12 (a temperature detection element), an A/D converter 13, an ignition circuit 14, a drive circuit 15, a resistance-value detection circuit 16, an EEPROM (Electrically Erasable Programmable Read-Only Memory) 17, a ROM (Read-Only Memory) 18, a RAM (Random Access Memory) 19, a timer 20, and a central processing unit (CPU) 21. These constituent elements of the ECU 10 are housed in a body 10*a* of the ECU 10. Typically, the ECU 10 and the engine are in contact with outside air on the respective peripheries and the ECU 10 is placed away from the engine so as not to be affected by radiant heat of the engine and heat transfer from the engine.

The waveform shaping circuit 11 shapes a crank pulse signal corresponding to a rotation angle of a crankshaft 3 of the engine, which is output from a crank angle sensor 2, to generate a digital pulse signal. The waveform shaping circuit 11 outputs the digital pulse signal generated in this way to the CPU 21.

The thermistor element 12 is a chip thermistor placed at a position away from a heating element, which is typically the ignition circuit 14, and on an ambient side of the ECU 10 (for example, a position being close to the body 10*a* and at a distance of about several millimeters to the body 10*a*) in the body 10*a* of the ECU 10, and detects an ambient temperature (an outside air temperature) being an atmosphere temperature around the outside of the body 10*a* of the ECU 10. Specifically, the thermistor element 12 outputs an electric signal having an electric resistance value corresponding to the ambient temperature and indicating a voltage corresponding to the electric resistance value to the A/D converter 13. The thermistor element 12 can be replaced by other temperature sensors such as a thermocouple, as long as the temperature sensors can output the electric signal as described above. The temperature detected by the thermistor element 12 is equal to an ambient temperature (an outside air temperature) being an atmosphere temperature around the engine.

The A/D converter 13 converts each of an electric signal that indicates an opening degree of a throttle valve of the engine and that is output from a throttle opening-degree sensor 4, an electric signal that indicates an oxygen concentration in the atmosphere absorbed by the engine and that is output from an oxygen sensor 5, and an electric signal that indicates an ambient temperature and that is output from the thermistor element 12 from an analog form into a digital form. The A/D converter 13 outputs these electric signals having been converted into the digital form in this way to the CPU 21.

The ignition circuit 14 includes a switching element such as a transistor that is controlled to be on/off in accordance with a control signal from the CPU 21. The switching element performs an on/off operation to control the operation of an ignition coil 6 that generates a secondary voltage for igniting a mixture including fuel and air in the engine via a sparking plug (not shown). The ignition circuit 14 is typically a driver IC (Integrated Circuit) being a semiconductor element and is a constituent element generating a largest amount of heat in the body 10*a*.

The drive circuit 15 includes a switching element such as a transistor that is controlled to be on/off in accordance with a control signal from the CPU 21, and the switching element performs an on/off operation to switch between energized and non-energized states of a coil 7*a* of an injector 7 that supplies fuel to the engine. The injector 7 is attached to an air intake pipe or a cylinder head (both not shown) of the engine and heat generated by the engine is transferred to the injector 7. As particularly shown in FIG. 1B, an equivalent circuit 7*b* of the coil 7*a* of the injector 7 is represented by a series circuit including an inductance component L and an electric resistance component R. The coil 7*a* is a constituent part for electrically driving a solenoid 7*c* of the injector 7 and the solenoid 7*c* operates in an energized state of the coil 7*a*, so that the fuel is injected from the injector 7.

The resistance-value detection circuit 16 measures an electric resistance value (a resistance value) being a physical amount that fluctuates depending on the electric resistance component of the coil 7*a* of the injector 7, and outputs an electric signal indicating the resistance value measured in this way to the CPU 21.

The EEPROM 17 has stored therein data related to various learned values such as a fuel-injection-amount learned value and a throttle-reference-position learned value. The EEPROM 17 can be replaced by other storage media such as a data flash, as long as the media can store therein data or the like related to these various learned values.

The ROM 18 is constituted by a non-volatile storage device and has stored therein various types of control data such as control programs for INJ cooling-amount calculation processing, engine-temperature calculation processing, and the like, and table data to be used in the INJ cooling-amount calculation processing and the engine-temperature calculation processing, which will be described later.

The RAM 19 is constituted by a volatile storage device and functions as a working area of the CPU 21.

The timer 20 performs timing processing in accordance with a control signal from the CPU 21.

The CPU 21 controls the entire operation of the ECU 10. In the present embodiment, the CPU 21 executes a control program, which is stored in the ROM 18, to function as an injector-temperature calculation unit 21*a*, an engine-temperature calculation unit 21*b*, an operating-state control unit 21*c*, and an integration-time calculation unit 21*d*. The injector-temperature calculation unit 21*a* calculates the temperature of the injector 7 (injector temperature) corresponding to a resistance value of the coil 7*a* of the injector 7. The engine-temperature calculation unit 21*b* calculates the temperature of the engine (engine temperature) based on the injector temperature calculated by the injector-temperature calculation unit 21*a*. The operating-state control unit 21*c* controls the operating state of the engine by controlling the ignition circuit 14 and the drive circuit 15 based on the engine temperature calculated by the engine-temperature calculation unit 21*b*. The integration-time calculation unit 21*d* calculates a driving time of the injector 7 and also calculates a fuel-injection integration time by integrating the driving time of the injector 7 in a predetermined period.

The injector temperature is cited as a preferred example of the temperature of a functional equipment of the engine from a viewpoint of ease of the measurement and the like. However, other functional devices can be used as the functional equipment of the engine as long as the functional devices can measure the resistance value corresponding to the engine temperature, and the temperature of the functional devices can be used as the temperature of the functional equipment of the engine. When the engine temperature correlated with the injector temperature is to be acquired, it is easy that the temperature of a spark plug seat of the engine is actually measured to acquire the engine temperature in view of a fact that the temperature of the spark plug seat of the engine is close to the actual temperature of the inside of the engine.

A divergence that may occur between the calculated injector temperature and an injector temperature having an appropriate correlation with the actual engine temperature, caused by an influence of the driving wind, which should be taken into consideration at the time of calculating the injector temperature, is explained with reference to FIG. 2.

Figure 2:
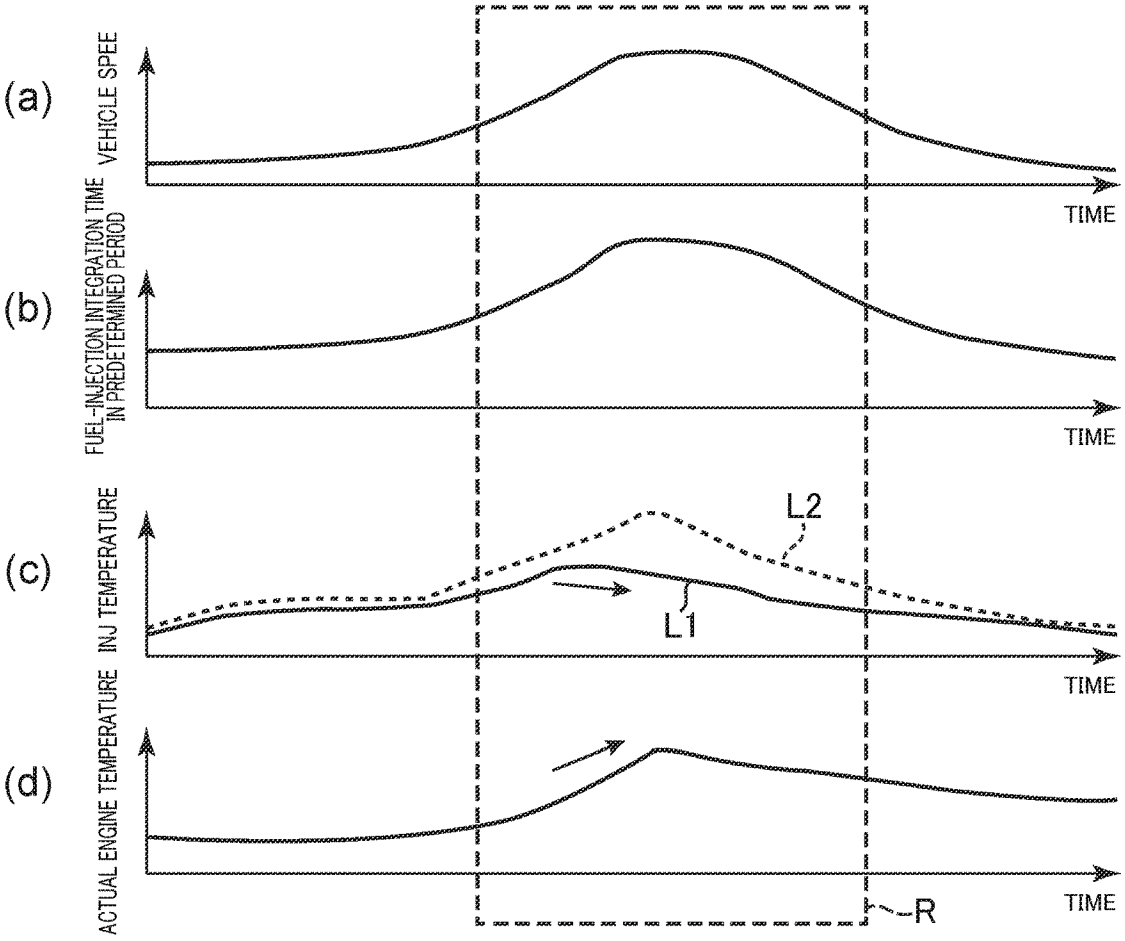
FIG. 2 is a diagram showing an example of a temporal change of a vehicle speed of a vehicle on which the internal combustion engine control device according to the present embodiment is mounted, and temporal changes of an actual engine temperature (real engine temperature), an injector temperature (INJ temperature), and a fuel-injection integration time in a predetermined period, corresponding to the change of the vehicle speed.

FIG. 2 is a diagram showing an example of a temporal change of a vehicle speed of a vehicle on which the internal combustion engine control device 1 according to the present embodiment is mounted, and temporal changes of an actual engine temperature (real engine temperature), an injector temperature (INJ temperature), and the fuel-injection integration time in a predetermined period, corresponding to the change of the vehicle speed.

As shown in a frame R in FIG. 2, when the vehicle speed shown in FIG. 2(*a*) increases, a divergence occurs in the correlation between the injector temperature shown in FIG. 2(*c*) and the engine temperature shown in FIG. 2(*d*), due to a difference of a cooling speed therebetween by the driving wind. As shown by a curved line L1 in FIG. 2(*c*), the temperature of the injector 7 having a smaller heat capacity than that of the engine drops earlier than the engine temperature, thereby causing a divergence between the calculated injector temperature and the injector temperature having the appropriate correlation with the actual engine temperature. On the other hand, in an acceleration state of a general vehicle, the fuel injection amount normally increases as the vehicle speed increases. In such a case, the fuel-injection integration time has a correlation with the vehicle speed.

Therefore, in the present embodiment, first focusing on the correlation between the fuel-injection integration time and the vehicle speed, the fuel-injection integration time is calculated by integrating driving time of the injector 7 in the predetermined period as shown in FIG. 2(*b*). As shown by a curved line L2 in FIG. 2(*c*), the injector temperature is corrected based on the fuel-injection integration time, and the engine temperature is calculated by using the injector temperature corrected in this way (corrected injector temperature). Accordingly, the engine temperature can be calculated accurately in a mode in which the influence of the driving wind is taken into consideration.

The operation of the internal combustion engine control device 1 at the time of performing the INJ (injector) cooling-amount calculation processing and the engine-temperature calculation processing in the present embodiment is explained more specifically below also with reference to FIG. 3A, FIG. 3B, FIG. 4(A), and FIG. 4(B).

[INJ Cooling-Amount Calculation Processing]

Figure 3A:
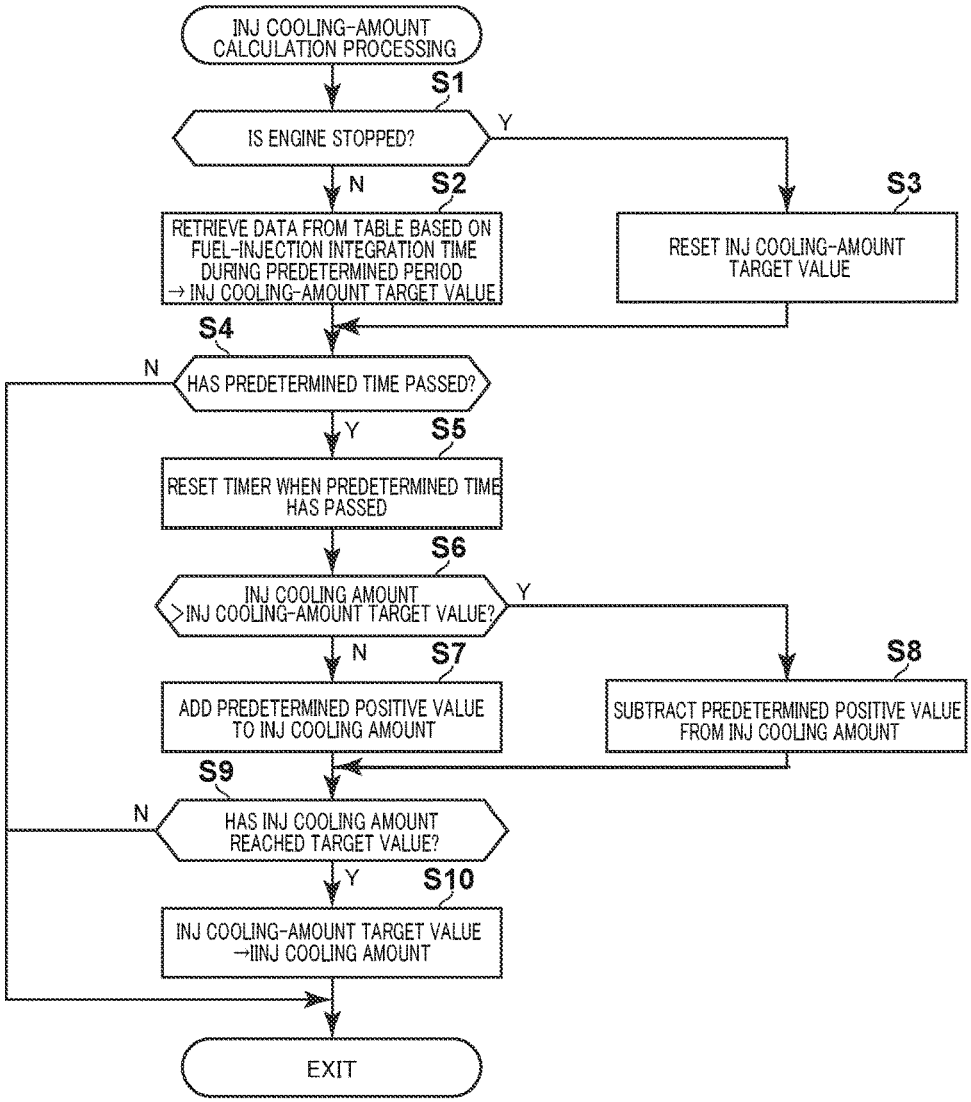
FIG. 3A is a flowchart showing a flow of INJ (injector) cooling-amount calculation processing of the internal combustion engine control device according to the present embodiment.
Figure 3B:
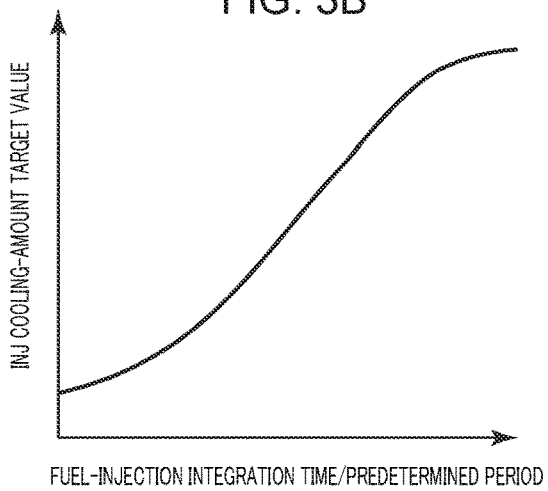
FIG. 3B is a diagram showing an example of table data representing a relation between an INJ cooling-amount target value and a value obtained by dividing the fuel-injection integration time by the predetermined period, which is used in the INJ cooling-amount calculation processing of the internal combustion engine control device according to the present embodiment.

A flow of the INJ cooling-amount calculation processing of the internal combustion engine control device 1 according to the present embodiment is explained first with reference to FIG. 3A and FIG. 3B.

FIG. 3A is a flowchart showing a flow of the INJ cooling-amount calculation processing of the internal combustion engine control device 1 according to the present embodiment. FIG. 3B is a diagram showing an example of table data representing a relation between an INJ cooling-amount target value and a value obtained by dividing the fuel-injection integration time by the predetermined period, which is used in the INJ cooling-amount calculation processing.

The flowchart shown in FIG. 3A is performed as one of processing in the engine-temperature calculation processing shown in FIG. 4A and FIG. 4B described later, which starts at a timing when an ignition switch of a vehicle is switched from an off-state to an on-state and the CPU 21 operates, and then the INJ cooling-amount calculation processing proceeds to a process at Step S1, in the engine-temperature calculation processing. This INJ cooling-amount calculation processing is repeatedly performed for each predetermined control period while the ignition switch of the vehicle is in the on-state and the CPU 21 is operating.

In the process at Step S1, the engine-temperature calculation unit 21*b* discriminates whether the engine is in a stopped state (the engine is stopped) by referring to the number of revolutions of the engine acquired based on a signal input from the crank angle sensor 2 via the waveform shaping circuit 11. When a result of discrimination indicates that the engine is stopped (YES at Step S1), the engine-temperature calculation unit 21*b* causes the INJ cooling-amount calculation processing to proceed to a process at Step S3. On the other hand, when the engine is not stopped (NO at Step S1), the engine-temperature calculation unit 21*b* causes the INJ cooling-amount calculation processing to proceed to a process at Step S2.

In the process at Step S2, the integration-time calculation unit 21*d* calculates the fuel-injection integration time obtained by integrating the driving time of the injector 7 in the predetermined period. The engine-temperature calculation unit 21*b* calculates an INJ cooling-amount target value by using the fuel-injection integration time during the predetermined period. Specifically, the engine-temperature calculation unit 21*b* retrieves the INJ cooling-amount target value corresponding to the fuel-injection integration time calculated in this way from the table data representing the relation between the INJ cooling-amount target value and a value obtained by dividing the fuel-injection integration time by the predetermined period as shown in FIG. 3B. In the relation between the INJ cooling-amount target value and the value obtained by dividing the fuel-injection integration time by the predetermined period shown in FIG. 3B, it is preferred that the INJ cooling-amount target value gradually increases with an increase of the INJ cooling-amount target value and an increase of the value obtained by dividing the fuel-injection integration time by the predetermined period. Accordingly, the process at Step S2 is completed and the INJ cooling-amount calculation processing proceeds to a process at Step S4.

In the process at Step S3, the engine-temperature calculation unit 21*b* resets the INJ cooling-amount target value to a predetermined initial value. Accordingly, the process at Step S3 is completed and the INJ cooling-amount calculation processing proceeds to the process at Step S4.

In the process at Step S4, the engine-temperature calculation unit 21*b* discriminates whether a predetermined time has passed based on a count value of the timer 20. When a result of discrimination indicates that the predetermined time has passed (YES at Step S4), the engine-temperature calculation unit 21*b* causes the INJ cooling-amount calculation processing to proceed to a process at Step S5. On the other hand, when the predetermined time has not passed (NO at Step S4), the engine-temperature calculation unit 21*b* ends this series of INJ cooling-amount calculation processing.

In the process at Step S5, the engine-temperature calculation unit 21*b* resets the count value of the timer 20 that measures the predetermined time. Accordingly, the process at Step S5 is completed, and the INJ cooling-amount calculation processing proceeds to a process at Step S6.

In the process at Step S6, the engine-temperature calculation unit 21*b* discriminates whether the INJ cooling amount is larger than the INJ cooling-amount target value. When a result of discrimination indicates that the INJ cooling amount is larger than the INJ cooling-amount target value (YES at Step S6), the engine-temperature calculation unit 21*b* causes the INJ cooling-amount calculation processing to proceed to a process at Step S8. On the other hand, when the INJ cooling amount is not larger than the INJ cooling-amount target value (NO at Step S6), the engine-temperature calculation unit 21*b* causes the INJ cooling-amount calculation processing to proceed to a process at Step S7. The INJ cooling amount and the INJ cooling-amount target value respectively correspond to the correction value and the correction target value. Further, a predetermined initial value is set to the INJ cooling amount, at the time of initially performing these processes.

In the process at Step S7, the engine-temperature calculation unit 21*b* adds a predetermined positive value to the INJ cooling amount. Accordingly, the process at Step S7 is completed, and the INJ cooling-amount calculation processing proceeds to a process at Step S9.

In the process at Step S8, the engine-temperature calculation unit 21*b* subtracts a predetermined positive value from the INJ cooling amount. Accordingly, the process at Step S8 is completed, and the INJ cooling-amount calculation processing proceeds to the process at Step S9. The predetermined positive value added in the process at Step S7 and the predetermined positive value subtracted in the process at Step S8 can be the same value or a different value, and are not limited to a fixed value and can be a variable value.

In the process at Step S9, the engine-temperature calculation unit 21*b* discriminates whether the INJ cooling amount has reached the INJ cooling-amount target value. When a result of discrimination indicates that the INJ cooling amount has reached the INJ cooling-amount target value (YES at Step S9), the engine-temperature calculation unit 21*b* causes the INJ cooling-amount calculation processing to proceed to a process at Step S10. On the other hand, when the INJ cooling amount has not reached the INJ cooling-amount target value (NO at Step S9), the engine-temperature calculation unit 21*b* ends this series of INJ cooling-amount calculation processing.

In the process at Step S10, the engine-temperature calculation unit 21*b* sets the INJ cooling-amount target value as the INJ cooling amount. According to such a series of processing, the INJ cooling amount can be shifted so as to gradually approach and reach the INJ cooling-amount target value. Accordingly, the process at Step S10 is completed, and this series of INJ cooling-amount calculation processing ends.

[Engine-Temperature Calculation Processing]

A flow of the engine-temperature calculation processing of the internal combustion engine control device 1 in the present embodiment and in a modification thereof is explained with reference to FIG. 4A and FIG. 4B.

Figure 4A:
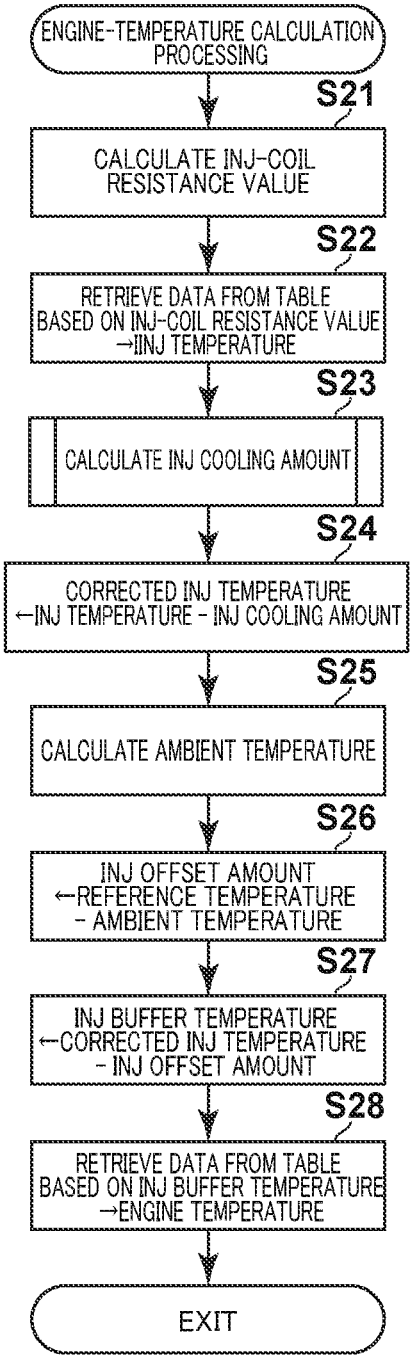
FIG. 4A is a flowchart showing a flow of engine-temperature calculation processing of the internal combustion engine control device according to the present embodiment.

FIG. 4A is a flowchart showing a flow of the engine-temperature calculation processing of the internal combustion engine control device 1 according to the present embodiment. FIG. 4B is a flowchart showing a flow of the engine-temperature calculation processing of the internal combustion engine control device 1 according to a modification of the present embodiment.

First, the flow of the engine-temperature calculation processing of the internal combustion engine control device 1 according to the present embodiment is explained with reference to FIG. 4A.

The flowchart shown in FIG. 4A starts at a timing when the ignition switch of the vehicle is switched from the off-state to the on-state and the CPU 21 operates, and then the engine-temperature calculation processing proceeds to a process at Step S21. The engine-temperature calculation processing is repeatedly performed for each predetermined control period while the ignition switch of the vehicle is in the on-state and the CPU 21 is operating.

In the process at Step S21, the injector-temperature calculation unit 21*a* calculates a resistance value of the coil 7*a* of the injector 7 (an INJ-coil resistance value), based on an output signal of the resistance-value detection circuit 16. Accordingly, the process at Step S21 is completed, and the engine-temperature calculation processing proceeds to a process at Step S22.

In the process at Step S22, the injector-temperature calculation unit 21*a* calculates an injector temperature by retrieving data of the injector temperature corresponding to the INJ-coil resistance value calculated in the process at Step S21, from the table data indicating a relation between the INJ-coil resistance value and the injector temperature (INJ temperature). Accordingly, the process at Step S22 is completed, and the engine-temperature calculation processing proceeds to a process at Step S23.

In the process at Step S23, the engine-temperature calculation unit 21*b* calculates the INJ cooling amount by performing the INJ cooling-amount calculation processing explained with reference to FIG. 3A and FIG. 3B. Accordingly, the process at Step S23 is completed, and the engine-temperature calculation processing proceeds to a process at Step S24.

In the process at Step S24, the engine-temperature calculation unit 21*b* calculates a value obtained by subtracting the INJ cooling amount calculated in the process at Step S23 from the injector temperature calculated in the process at Step S22 as a corrected injector temperature. Accordingly, the process at Step S24 is completed, and the engine-temperature calculation processing proceeds to a process at Step S25. In a state in which power of the internal combustion engine (the engine) is not connected to wheels, that is, in a state in which a gear of a transmission of the vehicle is neutral, typically, a cooling phenomenon due to the driving wind does not occur because the vehicle does not travel, even if the fuel-injection integration time of the internal combustion engine increases. Therefore, in this case, since correction in the process at Step S24 is not required, when it is detected that the gear is neutral, the process at Step S24 can be skipped so as not to be performed.

In the process at Step S25, the engine-temperature calculation unit 21*b* calculates an ambient temperature (an outside air temperature) being an atmosphere temperature around the outside of the body 10*a* of the ECU 10. Accordingly, the process at Step S25 is completed, and the engine-temperature calculation processing proceeds to a process at Step S26.

In the process at Step S26, the engine-temperature calculation unit 21*b* calculates a value obtained by subtracting the ambient temperature calculated in the process at Step S25 from a predetermined reference temperature as an offset amount of the injector temperature (an INJ offset amount). The INJ offset amount is another correction value for suppressing the influence of the ambient temperature with respect to the corrected injector temperature. Accordingly, the process at Step S26 is completed, and the engine-temperature calculation processing proceeds to a process at Step S27.

In the process at Step S27, the engine-temperature calculation unit 21*b* calculates a value obtained by subtracting the INJ offset amount calculated in the process at Step S26 from the corrected injector temperature calculated in the process at Step S24 as a buffer temperature of the injector 7 (INJ buffer temperature). Accordingly, the process at Step S27 is completed, and the engine-temperature calculation processing proceeds to a process at Step S28.

In a process at Step S28, the engine-temperature calculation unit 21*b* calculates the engine temperature by retrieving the data of the engine temperature corresponding to the INJ buffer temperature calculated in the process at Step S27, from table data indicating a relation between the INJ buffer temperature and the engine temperature. Accordingly, the process at Step S28 is completed, and this series of engine-temperature calculation processing ends. Thereafter, the operating-state control unit 21*c* controls the operating state of the engine by controlling the ignition circuit 14 and the drive circuit 15 based on the engine temperature calculated in this way.

Figure 4B:
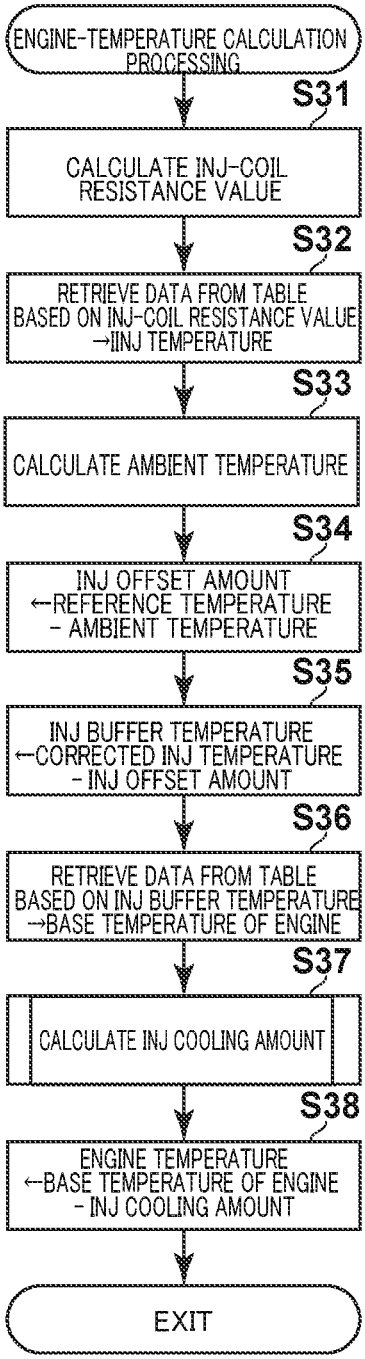
FIG. 4B is a flowchart showing a flow of engine-temperature calculation processing of an internal combustion engine control device according to a modification of the present embodiment.

A flow of the engine-temperature calculation processing of the internal combustion engine control device 1 according to the modification of the present embodiment with reference to FIG. 4B.

The flowchart shown in FIG. 4B starts at a timing when the ignition switch of the vehicle is switched from the off-state to the on-state and the CPU 21 operates, and then the engine-temperature calculation processing proceeds to a process at Step S31. The engine-temperature calculation processing is repeatedly performed for each predetermined control period while the ignition switch of the vehicle is in the on-state and the CPU 21 is operating.

In the process at Step S31, the injector-temperature calculation unit 21*a* calculates a resistance value of the coil 7*a* of the injector 7 (the INJ-coil resistance value), based on an output signal of the resistance-value detection circuit 16. Accordingly, the process at Step S31 is completed, and the engine-temperature calculation processing proceeds to a process at Step S32.

In the process at Step S32, the injector-temperature calculation unit 21*a* calculates an injector temperature by retrieving data of the injector temperature corresponding to the INJ-coil resistance value calculated in the process at Step S31, from the table data indicating a relation between the INJ-coil resistance value and the injector temperature (INJ temperature). Accordingly, the process at Step S32 is completed, and the engine-temperature calculation processing proceeds to a process at Step S33.

In the process at Step S33, the engine-temperature calculation unit 21*b* calculates an ambient temperature (an outside air temperature) being an atmosphere temperature around the outside of the body 10*a* of the ECU 10 based on an output signal of the thermistor element 12. Accordingly, the process at Step S33 is completed, and the engine-temperature calculation processing proceeds to a process at Step S34.

In the process at Step S34, the engine-temperature calculation unit 21*b* calculates a value obtained by subtracting the ambient temperature calculated in the process at Step S33 from a predetermined reference temperature as an offset amount of the injector temperature (the INJ offset amount). The INJ offset amount is another correction value for suppressing the influence of the ambient temperature with respect to the corrected injector temperature. Accordingly, the process at Step S34 is completed, and the engine-temperature calculation processing proceeds to a process at Step S35.

In the process at Step S35, the engine-temperature calculation unit 21*b* calculates a value obtained by subtracting the INJ offset amount calculated in the process at Step S34 from the injector temperature calculated in the process at Step S32 as a buffer temperature of the injector 7 (INJ buffer temperature). Accordingly, the process at Step S35 is completed, and the engine-temperature calculation processing proceeds to a process at Step S36.

In the process at Step S36, the engine-temperature calculation unit 21*b* calculates a base temperature of the engine by retrieving data of the base temperature of the engine corresponding to the INJ buffer temperature calculated in the process at Step S35, from table data indicating a relation between the INJ buffer temperature and the base temperature of the engine. Accordingly, the process at Step S36 is completed, and the engine-temperature calculation processing proceeds to a process at Step S37. The base temperature of the engine corresponds to a base temperature of the internal combustion engine.

In the process at Step S37, the engine-temperature calculation unit 21*b* calculates an INJ cooling amount by performing similar INJ cooling-amount calculation processing to that at Step S23 in the engine-temperature calculation processing of the present embodiment described above. However, the table indicating a relation between the INJ cooling-amount target value and the value obtained by dividing the fuel-injection integration time by the predetermined period at Step S2 in FIG. 3A is in a different mode from that of the embodiment described above. Accordingly, the process at Step S37 is completed, and the engine-temperature calculation processing proceeds to a process at Step S38.

In the process at Step S38, the engine-temperature calculation unit 21*b* calculates a value obtained by subtracting the INJ cooling amount calculated in the process at Step S37 from the base temperature of the engine retrieved by the process at Step S36 as the engine temperature. As for the process at Step S38, when it is detected that a gear of a transmission of a vehicle is neutral, the process at Step S38 can be skipped so as not to be performed because of the same reason as that in the process at Step S24. Accordingly, the process at Step S38 is completed, and this series of engine-temperature calculation processing ends. Thereafter, the operating-state control unit 21*c* controls the operating state of the engine by controlling the ignition circuit 14 and the drive circuit 15 based on the engine temperature calculated in this way.

As is apparent from the above explanations, according to the internal combustion engine control device 1 of the present embodiment, the engine-temperature calculation unit 21*b* calculates the engine temperature by using the injector temperature and the fuel-injection integration time. Therefore, by estimating the vehicle speed based on the correlation between the fuel-injection integration time and the vehicle speed in a predetermined period at the time of calculating the engine temperature based on the injector temperature, the engine temperature can be calculated appropriately, taking the influence of the driving wind into consideration.

Further, according to the internal combustion engine control device 1 of the present embodiment, the engine-temperature calculation unit 21*b* calculates the engine temperature by using the injector temperature and a value obtained by dividing the fuel-injection integration time by the predetermined period. Therefore, the engine temperature can be calculated appropriately, taking the influence of the driving wind into consideration.

According to the internal combustion engine control device 1 of the present embodiment, the engine-temperature calculation unit 21*b* calculates the corrected injector temperature obtained by correcting the injector temperature by the INJ cooling amount having a correlation with the fuel-injection integration time in the predetermined period, to calculate the engine temperature based on the corrected injector temperature. Therefore, the engine temperature can be calculated appropriately with a simple configuration, taking the influence of the driving wind into consideration.

Furthermore, according to the internal combustion engine control device 1 of the present embodiment, the engine-temperature calculation unit 21*b* calculates the INJ cooling-amount target value having a correlation with the fuel-injection integration time in the predetermined period, and gradually shifts the INJ cooling amount toward the INJ cooling-amount target value. Therefore, the engine temperature can be calculated appropriately in accordance with a change of the actual injector temperature, taking into consideration a fact that the cooling effect by the driving wind does not immediately appear on the injector temperature.

Furthermore, according to the internal combustion engine control device 1 of the present embodiment, the engine-temperature calculation unit 21*b* calculates the corrected injector temperature obtained by correcting the injector temperature by the INJ cooling amount having the correlation with the fuel-injection integration time in the predetermined period, calculates the base temperature of the engine based on the corrected injector temperature, and calculates the engine temperature by correcting the base temperature of the engine by the INJ cooling amount having the correlation with the fuel-injection integration time in the predetermined period. Therefore, the engine temperature can be calculated appropriately with a simple configuration, taking the influence of the driving wind into consideration.

In the present invention, the type, form, arrangement, number, and the like of the constituent members are not limited to those in the embodiment explained above, and it is needless to mention that the constituent elements can be modified as appropriate without departing from the scope of the invention, such as appropriately replacing these elements by other ones having identical operational effects.

For example, in the present embodiment, the temperature of the spark plug seat of the engine is used as the engine temperature corresponding to the injector temperature. However, the engine temperature is not limited thereto, and for example, a temperature of an engine cooling water or a temperature of a cylinder wall can be used.

Further, the configuration of the present embodiment can be used not only for a single-cylinder engine but also for a multi-cylinder engine. In this case, the temperature of each cylinder is estimated from the coil resistance vale of the injector of each cylinder of the multi-cylinder engine, thereby enabling to control the fuel injection amount and the like of each cylinder in accordance with the temperature of each cylinder.

INDUSTRIAL APPLICABILITY

As described above, the present invention can provide an internal combustion engine control device that can calculate the internal combustion engine temperature appropriately, taking the influence of the driving wind into consideration, at the time of calculating the internal combustion engine temperature based on the injector temperature. Therefore, because of its general purposes and universal characteristics, applications of the present invention can be expected in a wide range in the field of an internal combustion engine control device for a vehicle such as a two-wheeled automobile.

The invention claimed is:

1. An internal combustion engine control device applied to an internal combustion engine, the internal combustion engine control device comprising:

an injector-temperature calculation unit that calculates an injector temperature based on a coil resistance value of an injector;

an internal-combustion-engine temperature calculation unit that calculates a temperature of the internal combustion engine based on the injector temperature; and an operating-state control unit that controls an operating state of the internal combustion engine based on the temperature of the internal combustion engine, wherein the internal combustion engine control device further comprises an integration-time calculation unit that calculates a driving time of the injector and calculates a fuel-injection integration time obtained by integrating the driving time in a predetermined period, and the internal-combustion-engine temperature calculation unit calculates an injector cooling amount based on the fuel-injection integration time, and calculates the temperature of the internal combustion engine based on a corrected injector temperature calculated by correcting the injector temperature with the injector cooling amount, or calculates the temperature of the internal combustion engine by correcting a base temperature of the internal combustion engine, calculated on the basis of the injector temperature, with the injector cooling amount.

2. The internal combustion engine control device according to claim 1, wherein the internal-combustion-engine temperature calculation unit calculates the injector cooling-amount target value based on a value obtained by dividing the fuel-injection integration time by the predetermined period.

3. The internal combustion engine control device according to claim 1, wherein the internal-combustion-engine temperature calculation unit calculates an injector cooling-amount target value having a correlation with the fuel-injection integration time in the predetermined period, and when the internal-combustion-engine temperature calculation unit calculates the injector cooling amount, the internal-combustion-engine temperature calculation unit gradually shifts the injector cooling amount toward the injector cooling-amount target value.

* * * * *